United States Patent [19]

Hartley

[11] Patent Number: 4,768,656

[45] Date of Patent: Sep. 6, 1988

[54] COLLAPSIBLE STACKABLE SADDLE RACK

[76] Inventor: David A. Hartley, 850 W. Calora, San Dimas, Calif. 91773

[21] Appl. No.: 23,548

[22] Filed: Mar. 9, 1987

[51] Int. Cl.[4] ..... A47B 47/00

[52] U.S. Cl. ..... 211/13; 211/184; 211/189

[58] Field of Search ..... 211/189, 13, 191; D38/1; 403/252, 256, 382, 373

[56] References Cited

U.S. PATENT DOCUMENTS

| | | | |
|---|---|---|---|
| D. 200,164 | 1/1965 | Hyman | D38/1 |
| D. 208,155 | 7/1967 | Swanson et al. | D38/1 |
| D. 284,122 | 6/1986 | Kizen | D30/45 |
| 1,021,185 | 3/1912 | Foster | 403/256 X |
| 1,978,963 | 10/1934 | Schwaab | 403/256 X |
| 2,403,324 | 7/1946 | Anderson | 211/195 X |
| 2,809,755 | 10/1957 | Martorello . | |
| 3,001,750 | 9/1961 | Hedlund . | |
| 3,269,558 | 8/1966 | Hess | 211/184 |
| 3,464,565 | 9/1969 | Nevai | 211/42 |
| 3,476,255 | 11/1969 | Ciancio . | |
| 3,780,971 | 12/1973 | DeFillips | 248/309 |
| 3,827,574 | 9/1974 | Craig, Sr. | 211/184 |
| 4,182,432 | 1/1980 | Cossitt | 182/151 |
| 4,403,886 | 9/1983 | Haeusler | 211/182 X |
| 4,432,459 | 2/1984 | Coldren | 211/12 |
| 4,541,535 | 9/1985 | Bartholomew | 211/96 |

*Primary Examiner*—Ramon S. Britts
*Assistant Examiner*—Sarah A. Lechok Eley
*Attorney, Agent, or Firm*—Herb Boswell

[57] ABSTRACT

A saddle rack has a plurality of flat planar pieces which are stackable one on the other for storage. The pieces can temporarily be connected together into a self supporting saddle rack. Included among the pieces are first and second vertical end elements, a lower horizontal cross member and a plurality of upper horizontal cross members. The lower horizontal cross member has ends with each of the ends temporarily connectable to one of the end elements. Each of the upper horizontal have ends with each of the ends temporarily connectable to the top of one of the end elements.

4 Claims, 2 Drawing Sheets

COLLAPSIBLE STACKABLE SADDLE RACK

BACKGROUND OF INVENTION

This invention is directed to a collapsible saddle rack composed of interlocking pieces which fit together to form the saddle rack and when collapsed, stack one on the other for compact storage and/or transporting.

Saddle racks are utilized for storage of saddles when the saddles are not in use on a horse. Known saddle racks range from simple racks, a fence rail, to the complex. A saddle rack should provide a place to store a saddle off of the floor and out of the way of foot traffic. Additionally a saddle rack should properly support a saddle in a manner to preserve as best as possible the shape and structure of the saddle. Since saddles have certain bulk and weight, any saddle rack must have sufficient strength to support the weight of the saddle without collapsing.

Unfortunately the fence rail and its relative, the 2×4 piece of lumber, do nothing to properly support a saddle and preserve its shape and structure. In the tack room of a large stable, the saddle racks generally are permanent structures fixed to the wall of the tack room. For a smaller stable or for use away from the stable, a permanent type structure can be very disadvantageous. For these reasons, a variety of saddle racks have been developed. These generally fall into two categories, collapsible saddle racks and portable saddle racks.

U.S. Pat. Nos. 3,780,971 and 4,541,535 both describe collapsible saddle racks. However, with both of these racks, a supporting wall or other structure must be present to mount these racks on. U.S. Pat. No. 2,809,755 describes a saddle rack which is permanently mounted inside of a horse trailer using the horse trailer as its support.

U.S. Pat. Nos. 3,476,255 and Des. 200,164 both describe saddle racks having a triangular leg support structure. While these are certainly utilitarian, when used around horses or when swinging a heavy saddle up on to the saddle rack, this type of support does not provide as rigid a base as does a rectangular base. U.S. Pat. No. 208,155 describes a further fold up saddle rack. U.S. Pat. Nos. 4,432,459 and Des. 284,122 describe portable saddle racks but they are not collapsible.

BRIEF DESCRIPTION OF THE INVENTION

This invention provides for a saddle rack which is portable, collapsible and sturdy. The individual components or pieces of the saddle rack of the invention are stackable one on the other for storage and/or transport yet can be quickly and conveniently assembled into a rigid stable structure.

This can be advantageously achieved in a saddle rack which comprises first and second vertically oriented end elements each of which have an upper surface, a lower surface, an inside surface and an outside surface; a lower horizontal cross member having first and second ends; and a plurality of upper horizontal cross members, each of which have first and second ends. Further a first means is provided for temporarily connecting the first end of the lower horizontal cross member to the first end element and a second means for temporarily connecting the second end of the lower horizontal cross member to the second end element. Additionally, first further means equal in number to the number of the upper horizontal cross members are provided for temporarily connecting the upper horizontal cross members to the first end element adjacent to the upper surface of the first end element and second further means equal in number to the number of the upper horizontal cross members are provided for temporarily connecting the upper horizontal cross members to the second end element adjacent to the upper surfaces of the second end element. The plurality of upper horizontal cross members define a saddle support surface when the upper horizontal cross members and the lower horizontal cross member are temporarily connected to the respective first and second end elements by the respective connecting means.

In an illustrative embodiment of the invention, the upper surfaces of the first and the second end elements are essentially arcuate in shape in cross section so as to mimic the shaped of the inside of a riding saddle and a least a portion of the bottom surface of the first and second end elements is flat for supporting the saddle rack on a further surface.

In an illustrative embodiment of the invention the first and the second means for temporarily connecting the lower horizontal cross member to the first and the second end elements comprises mortise and tenon connectors located on said lower horiziontal cross member and the first and second end elements. A opening is provided in the tenons in a position such that when the tenons are mated with the mortise connectors, the opening is located on the opposite side of the end elements and a wedge is positioned in the opening to temporarily lock the tenon in the mortise connector.

In an illustrative embodiment of the invention each of the plurality of upper horizontal cross members includes a cross lap slot proximal to each of its ends and each of the first and the second end elements includes a plurality of cross lap slots equal in number to the number of the upper horizontal cross members. The cross lap slots in the first and the second end elements and the cross lap slots in the upper horizontal cross members are sized and shaped such that cross lap slots in the upper horizontal cross members interlock into the cross lap slots in the first and the second end elements to temporarily connect the upper horizontal cross members to the respective first and second end elements.

Further an advantageous saddle rack can be achieved utilizing a plurality of flat planar stackable elements. One of the flat planar stackable elements comprising a first end element, a further of the flat planar stackable elements comprising a second end element, a further of the flat planar stackable elements comprising a lower cross member and even a further of the flat planar stackable elements comprising an upper cross member utilized in conjunction with a means for temporarily connecting one of the upper cross member or the lower cross member in one of a horizontal or a vertical position with the flat plane of the member being perpendicular to the flat plane of each of the first and the second end elements and a further means for temporarily connecting the other of the upper cross member or the lower cross member in the other of the horizontal or vertical positions with the flat plane of the other member being perpendicular to the flat plane of each of the first and the second end elements.

A further advantageous saddle rack will utilize additional flat stackable elements as further upper cross members. An illustrative embodiment of this advantageous saddle rack utilizes mortise and tenon connector means for connecting the lower cross member to the end elements and cross lap joints for connecting the upper cross members to the end elements.

DESCRIPTION OF THE DRAWINGS

This invention will be better understood when taken in conjunction with the drawings wherein.

Figure 1:
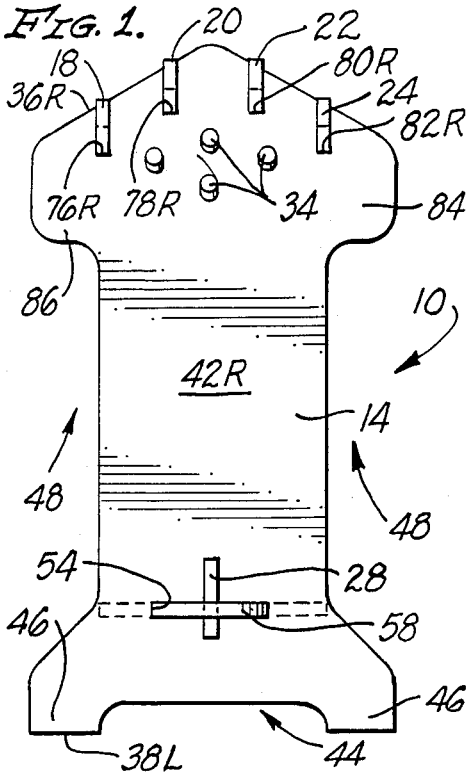
FIG. 1 is an end elevational view of a saddle rack of the invention.
Figure 3:
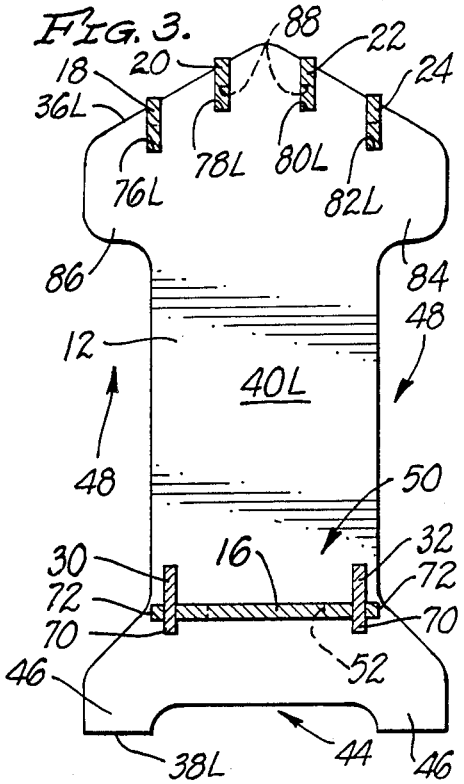
FIG. 3 is an elevational view in partial section about the lines 3—3 of FIG. 2.

The invention described in this specification and shown in the drawings utilizes certain principles and/or concepts as are set forth in the claims appended hereto. Those skilled in the saddle rack arts will realize that these principles and/or concepts are capable of being illustrated in a variety of embodiments which may differ from the exact embodiments utilized for illustrative purposes herein. For this reason this invention is not to be construed as being limited solely to the illustrative embodiments but is only to be construed in view of the claims.

DETAILED DESCRIPTION OF THE INVENTION

A saddle rack 10 of the invention is constructed of several components all of which can be assembled together into a temporary structure without forming any permanent joints, bonds or connections. No screws, glue, nails, nuts and bolts or like connectors are necessary to assemble the saddle rack 10 into a sturdy, self-supporting structure which is capable of firmly and securely holding a saddle and other associated tack. Because of the shape of the assembled saddle rack 10, any saddle supported on it will be supported in a manner contributing to the preservation and longevity of the saddle. In addition it provides for inherent structures for holding and storing saddle blankets, bridles, spurs and other gear.

With the exception of several round pegs (identified and further described below), all of the components of the saddle rack 10 are formed of flat, planar materials which are stackable one on the other for transportation and storage in an unassembled configuration. Thus when not in use or during transport, the saddle rack 10 of the invention can easily and conveniently be located or stored in a minimum of space and there will be no harm to the unassembled saddle rack 10 if other heavy objects are placed on it.

It is presently preferred to form the components parts of the saddle rack 10 of wood boards as for instance oak or the like. These are strong and provide a long service life for the saddle rack 10. It is of course recognized that other materials might be used to form one or more of all of the component parts of the saddle rack 10 utilizing the same construction techniques as are used for the wood construction.

The main components for constructing the saddle rack 10 are a left end element 12, a right end element 14, a lower horizontal cross member 16, four upper horizontal cross members 18, 20, 22 and 24, left and right side wedges 26 and 28, side rails 30 and 32 and bridle pegs collective numbered by the numeral 34. With the exception of the bridle pegs 34 each of these components parts are flat planar parts which are stackable one on the other or nest together as will be evident below.

The left and right end elements 12 and 14 each have an upper surface 36L and 36R respectively. They further have a bottom surface 38L and 38R respectively. Additionally they have an inside surface 40L and 40R respectively and an outside surface 42L and 42R respectively. As is evident from the figures, the upper surfaces 36L and 36R are arcuate in shape which mimics the shape of the inside surface of a riding saddle (not shown or numbered). Because of the shape of the upper surfaces 36L and 36R, when the upper cross members 18, 20, 22 and 24 are mounted to the end elements 12 and 14 as explained below, the upper cross members 18, 20, 22 and 24 also form a shape mimicking the shape of the inside surface of a saddle.

Figure 2:
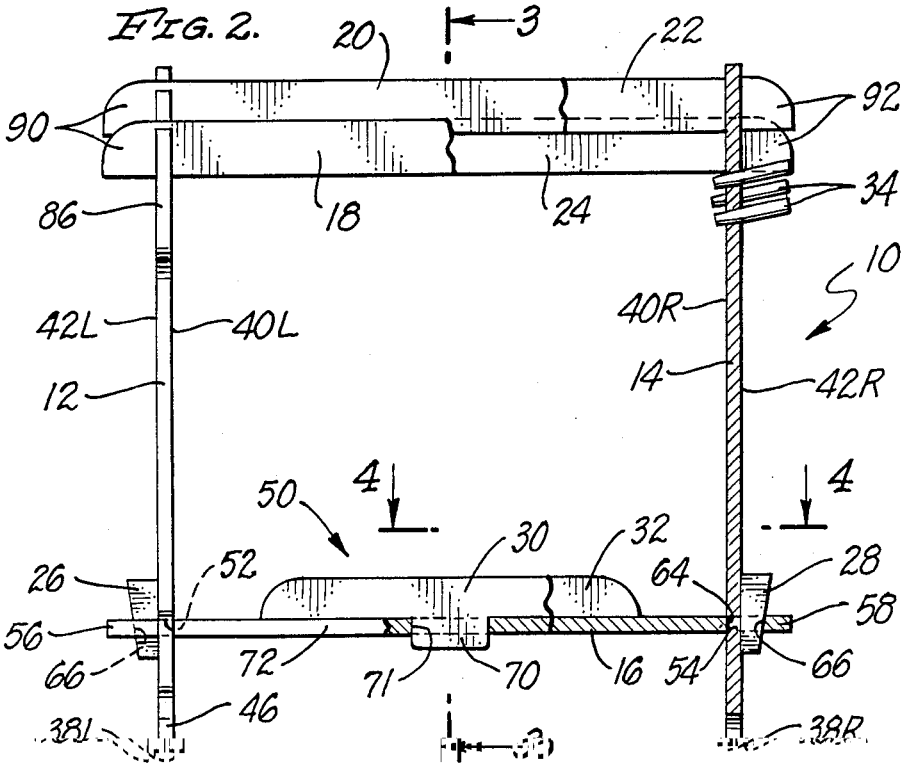
FIG. 2 is a side elevational view in partial section of the saddle rack of FIG. 1.

The bottom surfaces 38L and 38R of the respective end elements 12 and 14 form the supports for the saddle rack 10 on which it is supported on a further as for instance the ground, a stable floor or other structure. Each of the bottom surfaces 38L and 38R are shaped with a cut out area collectively identified by the numeral 44 which leaves the remaining material in the shape of feet collective identified by the numeral 46. Since the feet 46 on both the left end element 12 and right end element 14 are spread broadly apart and are "outboard" of a vertical line passing through the outboard most upper cross members 18 and 24, and end elements 12 and 14, as seen in FIGS. 1 and 2, are strongly supported against left to right rocking motion for stability of the saddle rack 10 when it is assembled. This further contributes to the stability of the saddle rack 10 when a saddle is located on it.

Further, since the feet 46 are directly connected to the broad end elements 12 and 14 by being integrally formed as a part of the end elements 12 and 14, the saddle rack 10 is much more stable than any saddle rack which is supported on long spindly legs. Additionally, during construction, the material removed from the cut out area 44 can be used to form the wedges 26 and 28 for conservation of construction material.

Each of the end elements 12 and 14 also included side cut out areas collective identified by the numeral 48. Again for conservation of construction material, the material removed to form these cut out areas 48 can be used to form the side rails 30 and 32. Aside from construction considerations, when a saddle is draped and supported on the saddle rack 10 the cut out areas 48 allow for ingress and egress to a shelf area 50 which is formed by the lower cross member 16 in conjunction with the side rails 30 and 32. Saddles have stirrups and a cinch which will hang down over the sides of the saddle rack 10 when the saddle is located thereon. The cinch can be conveniently "tucked" onto the shelf 50 to keeping it from dragging on the ground and out of the way so no one will trip on it. Depending on the length of the stirrups (which are adjustable), they to can also be positioned on the shelf 50 to keep them out of the way.

A mortise slot 52 is formed along a horizontal axis near the bottom of the left end element 12. A similar mortise slot 54 is formed in a like position in the end element 14. These are conveniently positioned at approximately the level of the bottom of the cut outs 48.

Figure 4:
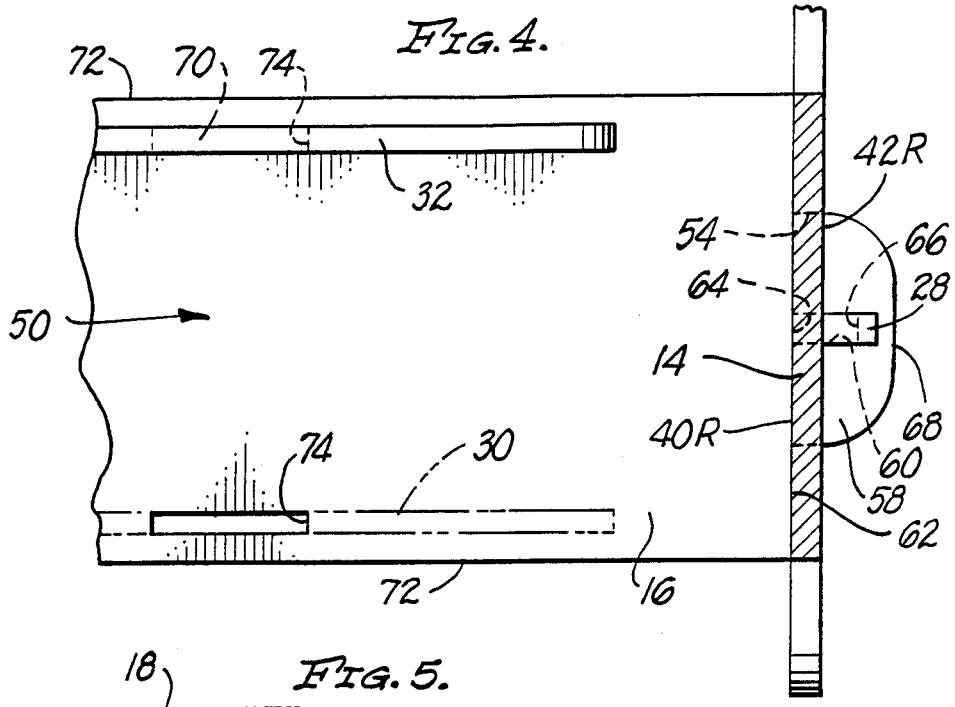
FIG. 4 is a fragmentary plan view in partial section about the lines 4—4 of FIG. 2.

As viewed in FIGS. 2 and 4, the lower cross member 16 has a greater length than its width and is of a width much greater than its thickness. Located on each of the two ends of its length are tenons 56 and 58 respectively. The tenons 56 and 58 are of a width less than the width of the lower cross member 16 and are sized to fit into the mortise slots 52 and 54 in the end elements 12 and 14 respectively.

In the center of each of the tenons 56 and 58 is an opening collective identified by the numeral 60. When the lower cross member 16 is fitted to the end elements 12 and 14 by inserting the tenons 56 and 58 through the mortise slots 52 and 54, the openings 60 are oriented to open in an up and down direction. The openings are sized with respect to a left and right axis as seen in FIG. 4 such that they extend back to the plane of the end edge 62 of the lower cross member 16 and have a first end 64 in this plane and their opposite end 66 near the end 68 of the respective tenons 56 and 48. The openings 60 are of a length with respect to the left and right axis of FIG. 4 so as to extend beyond the outside surface 42 (surface 42R in FIG. 4) of the end elements 12 and 14.

Because of the orientation and size of the openings 60, when the tenons 56 and 58 on the lower cross member 16 are positioned in the respective mortise slots 52 and 54 of the respective end elements 12 and 14 and the end edges 62 of the lower cross member 16 are abutted against the inside surfaces 40 of the end elements 12 and 14, at least a portion of each of the openings 60 are located in the plane of the outside surfaces 42 of the respective end elements 12 and 14 with the openings 60 extending further outwardly of the outside surfaces 42.

After the lower cross member 16 is fitted to the end elements 12 and 14, to hold the lower cross member 16 to end elements 12 and 14, the wedges 26 and 28 are tapped into the openings 60 in the tenons 56 and 58. As noted above, since a portion of the openings 60 are in the plane of the outside surfaces 42 of the end elements 12 and 14, the wedges 26 and 28 can be inserted between the outside surfaces 42 of the end elements and the end 66 of the openings 60.

When the wedges 26 and 28 are tap into the openings 60, the wedges spread the respective ends 66 of the respective openings away from the respective outside surfaces 42 of the end elements 12 and 14. This pulls the tenons 56 and 58 and the lower cross member 16 to which they are integrally formed, into the mortise slots 52 and 54 on the respective end elements 12 and 14 and brings the end edges 62 of the lower cross member 16 firmly against the inside surfaces 40 on the end elements 12 and 14 to temporarily firmly connect the lower cross member to the end elements 12 and 14. Of course to disassemble the lower cross member 16 from the end elements 12 and 14 all that is necessary is to tap the wedges 26 and 28 upwardly and remove them from the openings 60 and then slide the tenons 56 and 58 out of the mortise slots 52 and 54. One of the upper cross members 18, 20, 22 or 24 makes a very handy tapping tool for insertion or removal of the wedges 26 and 28.

The side rails 30 and 32 are temporarily held in the lower cross member 16 also by mortise and tenon connectors. Thus a tenon collective identified by the numeral 70 on the bottom of the side rail 30 or 32 is inserted in an appropriate opening collective identified by the numeral 74 in the lower cross member 16. This positions the side rails 30 and 32 parallel to the side edges collective identified by the numeral 72 of the lower cross member 16. Since the side rails 30 and 32 are not involved in the interlocking of the major support portions of the saddle rack 10, it is not necessary to lock them with wedges.

The upper cross members 18, 20, 22 and 24 are connected to the end elements 12 and 14 utilizing cross lap joints, more precisely, half cross lap joints. The upper surface 36 of each of the end elements 12 and 14 both have four slots, slots 76L, 78L, 80L and 82L in end element 12 and slots 76R, 78R, 80R and 82R in end element 14. These all are oriented up and down in a vertical orientation. This is contrasted to the horizontal orientation of the mortise slots 52 and 54 in the end elements 12 and 14, respectively. Two of the slots, slots 76 and 78, are located on one side of the center of the end elements 12 and 14 and the remaining two, slots 80 and 82, are located on the other side of the center of the end elements 12 and 14. The two end slots, slots 76 and 82, are positioned inwardly from the side edges of the end elements 12 and 14 such that an extension 84 and 86 is formed on both of the end elements 12 and 14. When a saddle is positioned on the saddle rack 10, the extensions 84 and 86 on the end elements keep the saddle from being inadvertently pushed off of one end or the other of the saddle rack 10 since the saddle will be located inboard of and between the extension 84 and 86.

Figure 5:
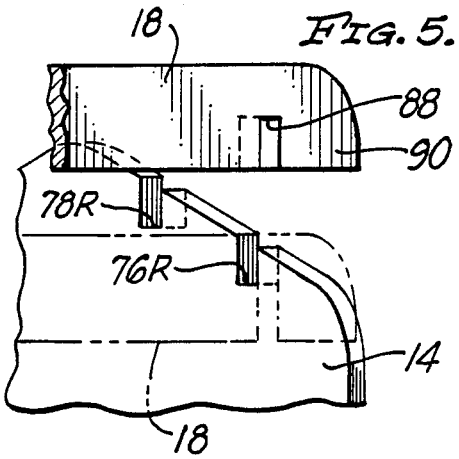
FIG. 5 is a fragmentary oblique view of portions of the top of the saddle rack seen in FIG. 1 with certain of the components in a first unconnected position in solid line and in a further connected position in phantom line.

Each of the upper cross members 18, 20, 22 and 24 have a half cross lap slot collective identified by the numeral 88 located proximal to each of their respective ends collective identified by the numerals 90 for the left ends and 92 for the right ends. As is seen in FIG. 5, the slot 88 near the right end 92 of the upper cross member 18 fits into and locks with the slot 76R on the end element 14. Each upper cross member 18, 20, 22 and 24 is assembled in turn to the end elements 12 and 14 by alignment of the slots 88 in the respective upper cross members 18, 20, 22 and 24 with the slots 76, 78, 80 and 82 in the respective end elements 12 and 14 and pushing the respective upper cross member down into the respective end elements.

The slot 88 near the end 92 of the cross member 18 and all of the remaining slots in the upper cross members 18, 20, 22 and 24 are half cross lap slots with the depth of the slots being one half of the vertical thickness of the upper cross member 18 (or one half the thickness of any of the other upper cross members since normally they all would be of the same thickness). The depth of the slot 76R and all of the remaining slots 76, 78, 80 and 82 in the end elements 12 and 14 are of the same dimension (depth) as the dimension of the slot 76R. Thus when the upper cross member 18 and all of the remaining cross members 18, 20 and 22 are fitted to the end elements 12 and 14, the upper cross members 18, 20, 22 and 24 fit down into the end elements 12 and 14 forming an essentially continuous structure with the upper surfaces 36 of the end elements 12 and 14. This forms a support surface for a saddle which essentially mimics the inside shape of the saddle.

When the end elements 12 and 14 are positioned in a vertical position as seen in the figures, the lower cross member 16 is located in a horizontal orientation perpendicular to the end elements and the upper cross members 28, 20, 22 and 24 are located in a vertical orientation also perpendicular to the end elements. Stated in different terms, the plane of end elements 12 and 14 is a first plane, the plane of the lower cross member 16 is a second plane which is perpendicular to the first plane and the plane of the upper cross members 18, 20, 22 and 24 is a third plane which is perpendicular to both the plane of end elements 12 and 14 and the plane of the lower cross member 16. Thus these three planes are orthogonal to each other. This makes the assembled saddle rack very stable and resistant to deflection in any direction even though it is only held together by simple connectors which only slide together.

Figure 6:
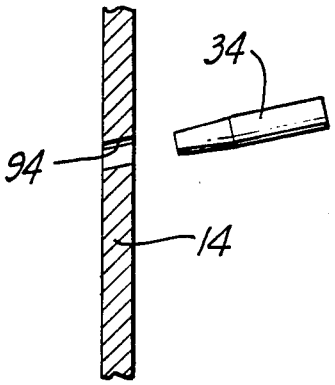
FIG. 6 is an exploded fragmentary elevational view in partial section of a portion of the top right hand side of the saddle rack of the invention as seen in FIG. 2.

The bridle pegs 34 slide into holes collective identified by the numeral 94 as seen in FIG. 6. As shown in the figures only the end element 14 includes the holes 94. It is evident however that similar holes could be located in the end element 12.

As described above, the component parts of the saddle rack 10 simply slide together and the structure is locked in position with the wedges 26 and 28. To assemble, the lower cross member 16 is connected to the end elements 12 and 14 and then the upper cross members are attached to this structure. As assembled the saddle rack 10 is of a convenient size and height for placement and storage of a saddle thereon. Prior to placement of the saddle on the saddle rack 10, the saddle blanket or blankets can be draped over the upper cross members 18, 20, 22 and 24 or can be folded and placed on the self 50 formed by the lower cross member 16 and side rails 30 and 32. Other tack can also be located on the shelf 50. Also as noted the shelf 50 provided a convenient location for the cinch.

When the saddle rack 10 is disassembled it can be stored in a stack the same width and length as that of one of the end elements 12 or 14 and of a height only equal to four thickness of one of its parts. As for instance, the first two thickness can be formed by stacking the end elements 12 and 14 one on the other with the side rails 30 and 32, the wedges 26 and 28 and the pegs 34 positioned in the cut out areas 48. Next the upper cross members 18, 20, 22 and 24 are laid next to one another on the uppermost of the end elements 12 or 14 to form the third thickness. Finally the lower cross member 16 is laid on top of the upper cross members.

I claim:

1. A saddle rack consisting of:

first and second vertically oriented end elements, each of said end elements having an upper surface, a lower surface, an inside surface and a outside surface, said upper surfaces of said first and said second end elements being arcuate in shape in cross section so as to mimic the shape of the inside of a riding saddle;

a least a portion of the bottom surface of said first and second end elements being flat for supporting said saddle rack on a further surface;

a lower horizontal cross member having first and second ends;

said first end element and said second end element each including a mortise slot located in said respective end elements, said mortise slots extending through said respective end elements between said inside and said outside surfaces of said respective end elements;

said lower horizontal cross member includes a tenon located on each of its respective first and second ends, said tenons sized and shaped to fit into and to connect with said mortise slots in said first and said second end elements positioning said lower horizontal cross member between the respective inside surfaces of said respective end elements;

said mortise slots in said first and said second end elements being horizontally oriented;

said lower horizontal cross member comprising a flat elongated member having a length greater than its width and a width much greater than its thickness;

each of said tenons formed as an extension of the length of said horizontal cross member with each of said tenons having a width less than the width of said horizontal cross member;

a vertically orientated opening in each of said tenons, said openings positioned in said tenons in locations wherein at least a portion of each of said openings is located in the plane of and slightly outwardly of the outside surface of a respective end element when the respective tenon is located in the respective mortise slot in said respective end element;

a first and a second wedge member, said wedge members sized and shaped to fit into said portion of said openings located outwardly of said plane of said outside surfaces of said respective end elements to temporarily lock said tenons in said mortise slot to temporarily fix said first and said second end elements to said horizontal cross member;

a plurality of upper horizontal cross member, each of said upper horizontal cross members having first and second ends;

each of said plurality of upper horizontal cross members includes a cross lap slot proximal to each of its ends;

each of said first and said second end elements includes a plurality of cross lap slots equal in number to the number of said upper horizontal cross members;

said cross lap slots in said first and said second end elements and said cross lap slots in said upper horizontal cross members sized and shaped such that cross lap slots in said upper horizontal cross members interlock into said cross lap slots in said first and said second end elements to temporarily connect said upper horizontal cross members to said respective first and second end elements; and said plurality of upper horizontal cross members defining a saddle support surface when said upper horizontal cross members and said lower horizontal cross member are temporarily connected to said respective first and second end elements.

2. A saddle rack of claim 1 wherein:

said lower horizontal cross member has a top, a bottom, left and right side edges and first and second end edges;

said saddle rack further including;

first and second lower member said rails;

means for temporarily connecting one of said lower member side rails on said top of said lower horizontal cross member adjacent to said left side edge and the other of said lower member side rails on said top of said lower horizontal cross member adjacent to said right side edge, and said means for connecting said lower member side rails comprises a least one tenon on each of said lower member side rails and at least two mortise slots extending between said top and said bottom of said lower horizontal cross member, one of said mortise slots located adjacent to and parallel to said right side edge of said lower horizontal cross member and the other of said mortise slots located adjacent to and parallel to said left side edge of said lower horizontal cross member.

3. A saddle rack consisting of:

a plurality of flat planar stackable elements;

one of said flat planar stackable elements comprising a first end element;

a further of said flat planar stackable elements comprising a second end element;

a further of said flat planar stackable elements comprising a lower cross member;

at least three further of said flat planar stackable elements comprising upper cross members;

means for temporarily connecting said lower cross member in an essentially horizontal plane with the flat plane of said member located perpendicular to the flat plane of each of said first and said second end elements;

means for temporarily connecting said upper cross members in essentially vertical planes with the flat plane of said members perpendicular to the flat plane of each of said first and said second end elements;

said means for temporarily connecting said lower cross member to said first and said second end elements comprises mortise and tenon connectors;

said mortise and tenon connectors include a mortise slot in each of said first and said second end elements, and said lower cross member having first and second ends with each of said ends including a tenon located on said end;

said tenons sized and shaped to interlock with said mortise slots;

an opening in each of said tenons;

first and second wedges for fitting into and locking in said openings;

said means for temporarily connecting said upper cross members to said first and said second end elements comprises cross lap slot connector means; and said essentially horizontal plane, said essentially vertical planes and the planes of said end elements each being essentially orthogonal to each other.

4. A saddle rack consisting of:

first and second vertically oriented end elements, each of said end elements having an upper surface, a lower surface, an inside surface and a outside surface, said upper surfaces of said first and said second end elements being arcuate in shape in cross section so as to mimic the shape of the inside of a riding saddle;

a least a portion of the bottom surface of said first and second end elements being flat for supporting said saddle rack on a further surface;

an elongated flat lower lower horizontal cross member having first and second ends;

said first end element and said second end element each including a mortise slot located in said respective end elements, said mortise slots extending through said respective end elements between said inside and said outside surfaces of said respective end elements;

said lower horizontal cross member includes a tenon located on each of its respective first and second ends, said tenons sized and shaped to fit into and to connect with said mortise slots in said first and said second end elements positioning said lower horizontal cross member between the respective inside surfaces of said respective end elements;

said mortise slots in said first and said second end elements being horizontally oriented;

each of said tenons formed as an extension of the length of said horizontal cross member with each of said tenons having a width less than the width of said horizontal cross member;

a vertically orientated opening in each of said tenons, said openings positioned in said tenons in locations wherein at least a portion of each of said openings is located in the plane of and slightly outwardly of the outside surface of a respective end element when the respective tenon is located in the respective mortise slot in said respective end element;

a first and a second wedge member, said wedge members sized and shaped to fit into said portion of said openings located outwardly of said plane of said outside surfaces of said respective end elements to temporarily lock said tenons in said mortise slots to temporarily fix said first and said second end elements to said horizontal cross member;

a plurality of upper horizontal cross members, each of said upper horizontal cross members having first and second ends;

each of said plurality of upper horizontal cross members includes a cross lap slot proximal to each of its ends;

each of said first and said second end elements includes a plurality of cross lap slots equal in number to the number of said upper horizontal cross members;

said cross lap slots in said first and said second end elements and said cross lap slots in said upper horizontal cross members sized and shaped such that cross lap slots in said upper horizontal cross members interlock into said cross lap slots in said first and said second end elements to temporarily connect said upper horizontal cross members to said respective first and second end elements;

said plurality of upper horizontal cross members defining a saddle support surface when said upper horizontal cross members and said lower horizontal cross member are temporarily connected to said respective first and second end elements;

said lower horizontal cross member has a top, a bottom, left and right side edges and first and second end edges;

first and second lower member side rails;

means for temporarily connecting one of said lower member side rails on said top of said lower horizontal cross member adjacent to said left side edge and the other of said lower member side rails on said top of said lower horizontal cross member adjacent to said right side edge, and said means for connecting said lower member side rails comprises a least one tenon on each of said lower member side rails and at least two mortise slots extending between said top and said bottom of said lower horizontal cross member, one of said mortise slots located adjacent to and parallel to said right side edge of said lower horizontal cross member and the other of said mortise slots located adjacent to and parallel to said left side edge of said lower horizontal cross member.

* * * * *

UNITED STATES PATENT AND TRADEMARK OFFICE

CERTIFICATE OF CORRECTION

PATENT NO. : 4,768,656

DATED : SEPTEMBER 6, 1988

INVENTOR(S) : DAVID A. HARTLEY

It is certified that error appears in the above-identified patent and that said Letters Patent is hereby corrected as shown below: Title page:

In the Abstract, line 9, insert --cross member-- between "horizontal" and "have".

Column 2, line 16, "shaped" should be --shape--.

Column 2, line 16, "and a" should be --and at--.

Column 2, line 25, "a opening" should be --an opening--.

Column 4, line 6, "collective" should be --collectively--.

Column 4, line 26, insert --surface-- between "further" and "as".

Column 4, line 50, "collective" should be --collectively--.

Column 4, line 64, "to" should be --too--.

Column 5, line 13, "collective" should be --collectively--.

Column 5, line 22, "48" should be --58--.

Column 5, line 45, "tap" should be --tapped--.

Column 5, line 65, "collective" should be --collectively--.

Column 5, line 67, "collective" should be --collectively--.

Column 6, line 2, "collective" should be --collectively--.

UNITED STATES PATENT AND TRADEMARK OFFICE

CERTIFICATE OF CORRECTION

PATENT NO. : 4,768,656

DATED : SEPTEMBER 6, 1988

INVENTOR(S) : DAVID A. HARTLEY

It is certified that error appears in the above-identified patent and that said Letters Patent is hereby corrected as shown below:

Column 6, line 30, "collective" should be --collectively--.

Column 6, line 32, "collective" should be --collectively--.

Column 6, line 65, "28" should be --18--.

Column 7, line 10, "collective" should be --collectively--.

Column 7, line 28, "provided" should be --provides--.

Column 8, line 24, "member" should be --members--.

Column 8, line 52, "said" should be --side--.

Column 8, line 60, "a" should be --at--.

Column 9, line 51, "a least" should be --at least--.

Column 9, line 54, delete the first occurrence of the word "lower".

Column 10, line 57, "a least" should be --at least--.

Column 7, line 51, "a least" should be --at least--.

Signed and Sealed this

Tenth Day of July, 1990

*Attest:*

HARRY F. MANBECK, JR.

*Attesting Officer*

*Commissioner of Patents and Trademarks*